United States Patent [19]

Diederichs

[11] 4,293,119

[45] Oct. 6, 1981

[54] TOOL FOR REMOVING STAPLES

[76] Inventor: John M. Diederichs, 3011 Ala Ilima, Apt. #203, Honolulu, Hi. 96818

[21] Appl. No.: 173,978

[22] Filed: Jul. 31, 1980

[51] Int. Cl.[3] ..... B25C 11/00

[52] U.S. Cl. ..... 254/28

[58] Field of Search ..... 254/18, 21–24, 254/28; 227/63; 29/267, 268, 280

[56] References Cited

U.S. PATENT DOCUMENTS

| | | | |
|---|---|---|---|
| 72,655 | 12/1867 | Marden | 254/22 |
| 813,223 | 2/1906 | Loreman | 254/24 |
| 1,134,177 | 4/1915 | Bernard | 254/22 X |
| 1,193,930 | 8/1916 | Schulz | 254/28 |
| 2,733,736 | 2/1956 | McLaughlin | 254/23 X |
| 2,870,988 | 1/1959 | Vazquez | 254/22 |

*Primary Examiner*—Robert C. Watson

*Attorney, Agent, or Firm*—William B. Walter

[57] ABSTRACT

A tool for use by one hand for removing staples from upholstered furniture has an upper and a lower pivotably connected and spring biased open needle nose jaws, the lower jaw of which is pivotably connected to a primary handle so that a short arm of the primary handle extending beyond the pivot connecting the primary handle to the lower jaw extends towards the points of the needle nose jaws to act against a short arm of the upper jaw to close the upper jaw against the lower jaw when the lower jaw has been forced under the bridge of a driven staple and the arm pressed down to pry the staple out of the wood in which it has been driven thus clamping the bridge of the staple to the tool during removal. A secondary arm pivotably connected to the primary handle has a short arm extended beyond the pivotable connection which when the handles are squeezed together acts against the lower jaw to close the jaws together against the force of the bias spring in the nature of a needle nose plier for removing single legs of a broken staple.

1 Claim, 8 Drawing Figures

TOOL FOR REMOVING STAPLES

BACKGROUND OF THE INVENTION

A time and energy consuming part of furniture reupholstering is the removal of staples attaching the old upholstery to the wood frame of the furniture. Although screwdrivers and the like are commonly used to remove staples for such work, the time required for each staple is frequently doubled because the screwdriver slides along the bridge of the staple, the prying force is concentrated on one leg of the staple, and the staple is then removed one leg at a time. If the staple breaks in the process, two additional actions are required to remove the legs separately with a long needle-nosed plier. Various spike and nail extractors have been devised to reduce the work required in this similar operation and to reduce damage to nail and wood surface as the nail is removed. Examples of such tools are those disclosed in U.S. Pat. Nos. 616,618 (Iverson et al), 813,223 (Loreman), and 2,870,988 (Vasquez). Examples of tools devised specifically for removing staples are those shown in U.S. Pat. Nos. 650,186 (Maxson), 1,193,930 (Schulz), and 2,976,016 (Fennell). Of these tools, all but 2,870,988 and 2,976,016 are designed in such a way that in use the handle is approximately vertical to the work. The working head of each of these tools is relatively large thus requiring generous access space surrounding the fastener to be removed.

Because of the irregularity of furniture framing and interference between legs, arms and other surfaces of furniture, there is a demonstrated need for a staple removing tool the staple contacting head of which will fit into relatively inaccessible areas, and which will ordinarily remove the staple in one operation. There is also a need in such a tool for the ability to remove an individual leg of a staple after the other leg has been removed or when the bridge of the staple breaks.

BRIEF SUMMARY OF THE INVENTION

It is the primary object of this invention to provide a tool which will allow its user to quickly remove the staples in upholstered furniture in one piece and in relatively inaccessible areas.

A second object of the invention is to provide a tool for the removal of staples, the head of which tool can grasp a single leg of a staple to remove it from the wood into which it has been driven as well as remove the intact staples. The invention is a staple remover operable by one hand having an upper and a lower long or needle nosed jaw pivotably joined to allow opening and closing of the space between them, spring-biased open, and a longitudinal handle pivotably joined to the lower jaw so that an extended nose of the handle beyond the pivot extends under the trailing end of the upper jaw beyond its pivot for a prying action to close the jaws on the staple as the staple is being pryed loose from the wood. A second longitudinal handle pivotably joined to the side of the primary handle has an extension arm adjacent to its pivot acting against the lower jaw to allow the tool's use as a needle-nosed or long-nosed plier for extracting the remaining portions of broken or partially removed staples.

DETAILED DESCRIPTION OF THE INVENTION

Figure 1:
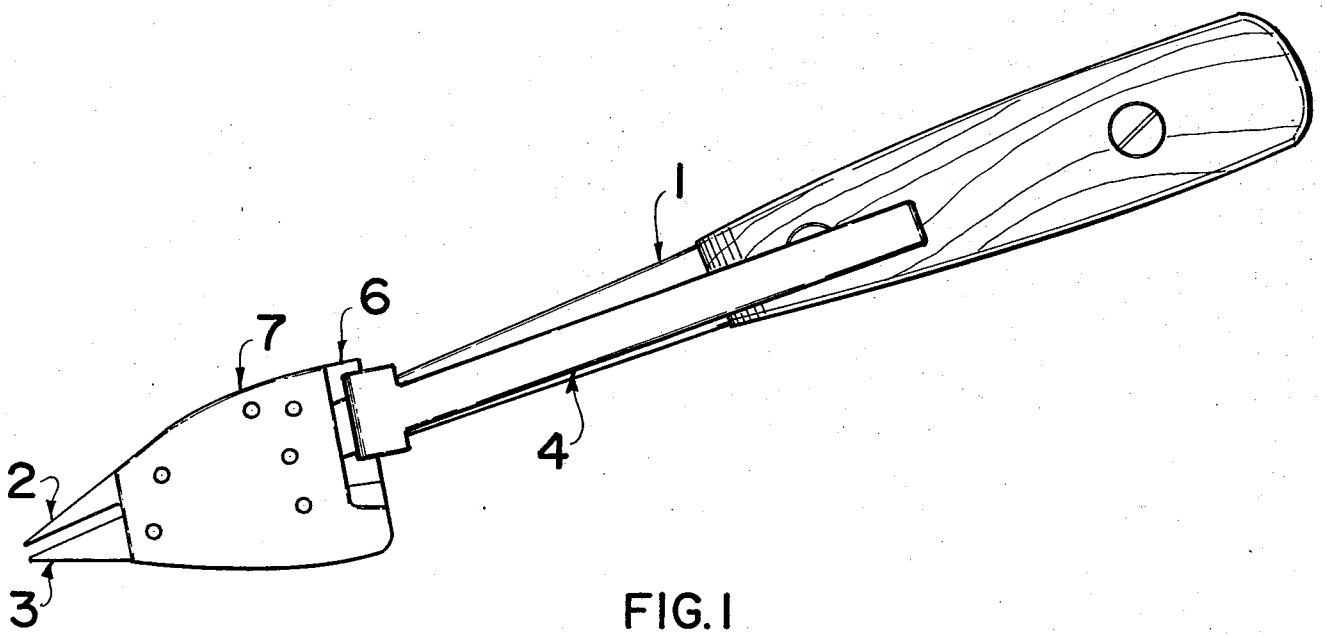
FIG. 1 is a left hand elevation of a preferred embodiment of the staple removing tool of my invention.

As shown in FIG. 1, the staple remover of my invention has a primary handle 1 attached to an assembly of an upper needle nose jaw 2 and a lower needle nose jaw 3 with a secondary longitudinal handle 4 lying alongside the primary handle 1.

Figure 2:
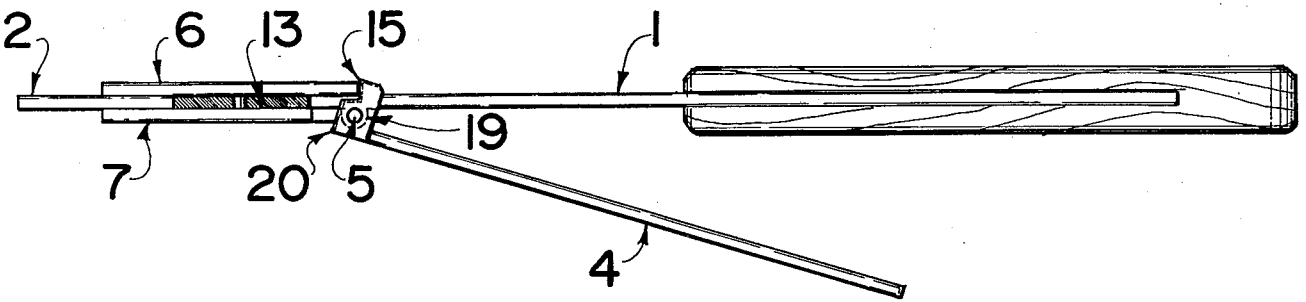
FIG. 2 is a plan view of the tool of FIG. 1.

It will be noted in the plan view of the staple remover as seen in FIG. 2 that the secondary handle 4 is pivotably attached to the side of the primary handle 1 by a pivot 5 which is between the two handles. Also to be noted in FIG. 2 is the relationship of the primary handle 1, the upper jaw 2 and the lower jaw 3 as they are held between the right hand side plate 6 and the left hand side plate 7.

Figure 3:
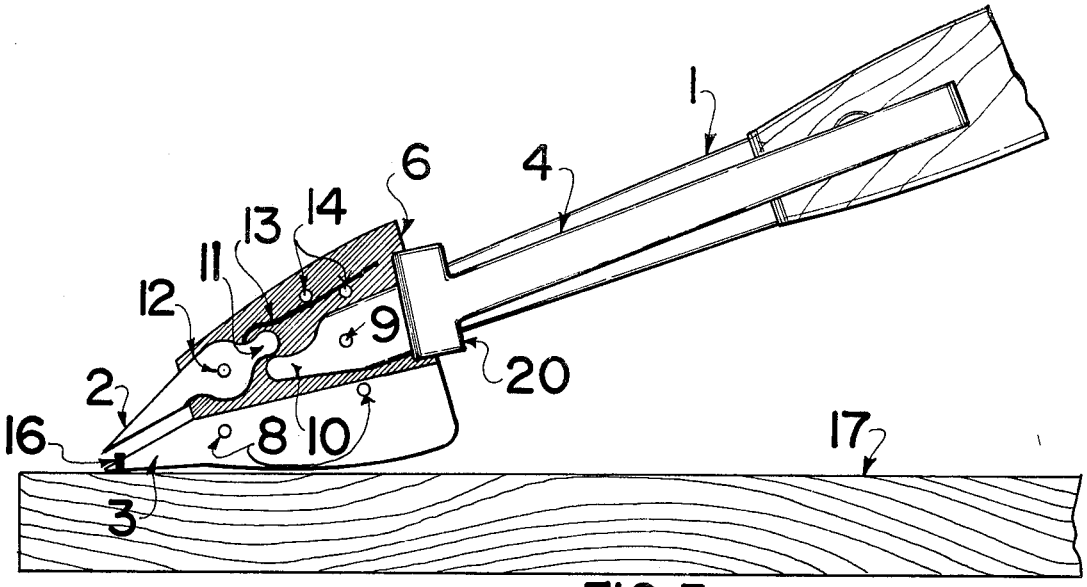
FIG. 3 is a left hand elevation of the tool of FIGS. 1 and 2 with the left hand side plate removed to reveal the working elements of the tool when the lower jaw is first inserted under the staple.
Figure 4:
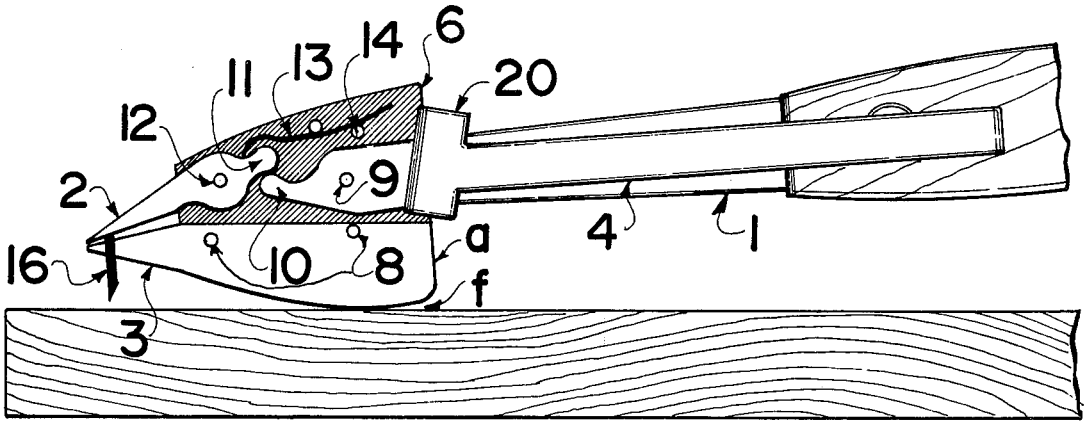
FIG. 4 is a left hand elevation similar to FIG. 3 of the tool of FIGS. 1–3 when the staple is grasped by the tool as it is being pried out of the wood.
Figure 5:
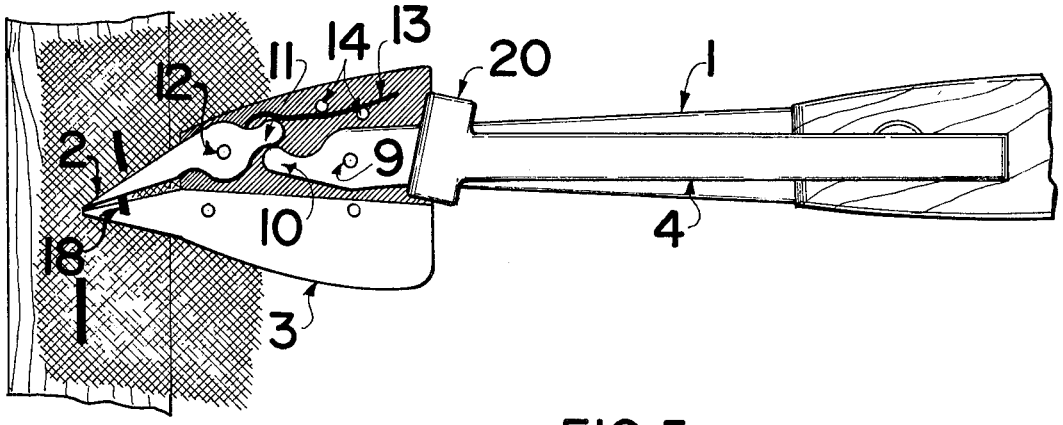
FIG. 5 is a left hand view similar to FIGS. 3 and 4 of the tool of FIGS. 1–4 when the secondary handle is depressed or squeezed towards the primary handle to draw the jaws together against one leg of a staple.

In the left hand views of FIGS. 3–5 with the left hand side plate 7 removed, it will be noted that the lower jaw 3 is held in a fixed position between the side plates 6 and 7 by rivets 8 so that in effect, the side plates 6 and 7 with the lower jaw 3 constitute a lower jaw assembly. The primary handle 1 is fastened to the lower jaw 3 by a pivot 9 extending through side plates 6 and 7 with an extended nose 10 of the primary handle 1 extending beyond the pivot 9 so as to act against the lower face of the trailing end 11 of the upper jaw 2. The upper jaw 2 is attached to the lower jaw 3 by a pivot pin 12 extending through the side plates 6 and 7 so that the upper jaw 2 can be swung to open or close the upper jaw 2 against the lower jaw 3. A leaf spring 13 anchored to the lower jaw by rivets 14 extending through side plates 6 and 7 acts against the upper face of the trailing end 11 of the upper jaw 2 to normally hold it in the jaws open position. As best seen in FIG. 2, an arm 15 of the secondary handle 4 can act against the trailing end of the lower jaw assembly at the right hand side plate 6.

Figure 6:
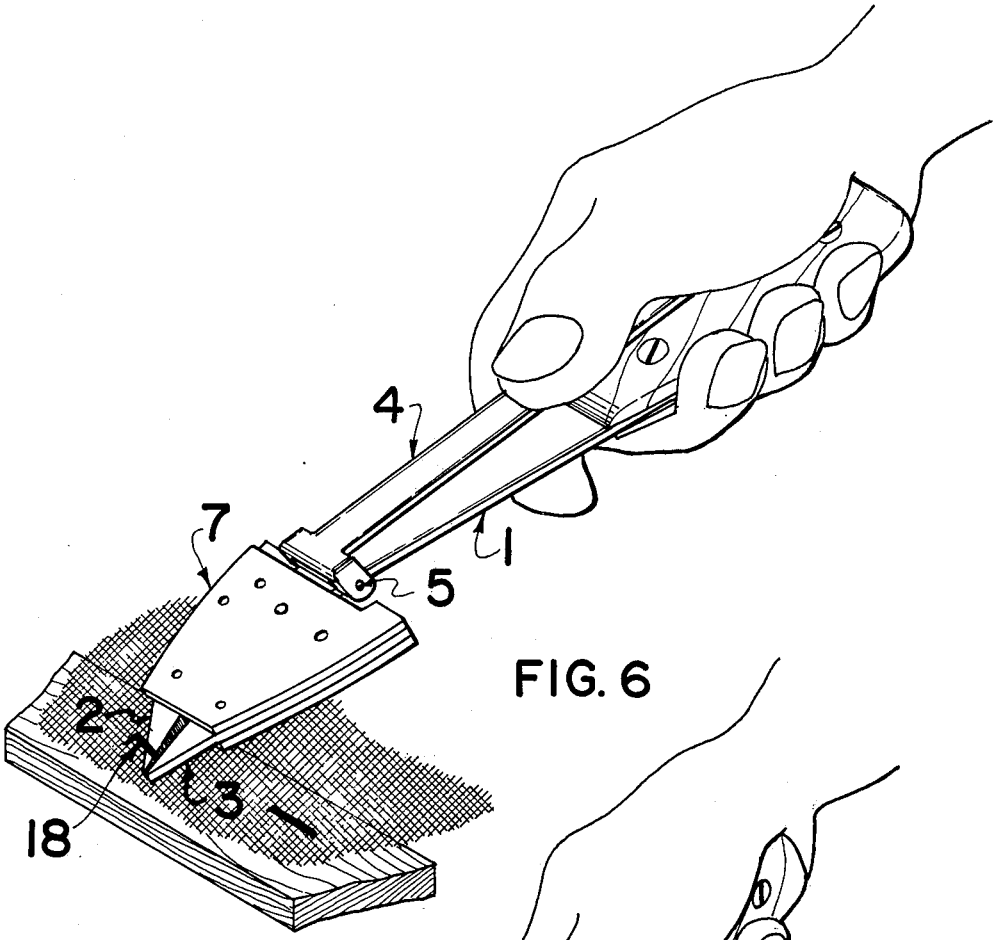
FIG. 6 is a perspective view of the staple remover of FIGS. 1–5 as it is being used to remove a broken leg of a staple.
Figure 7:
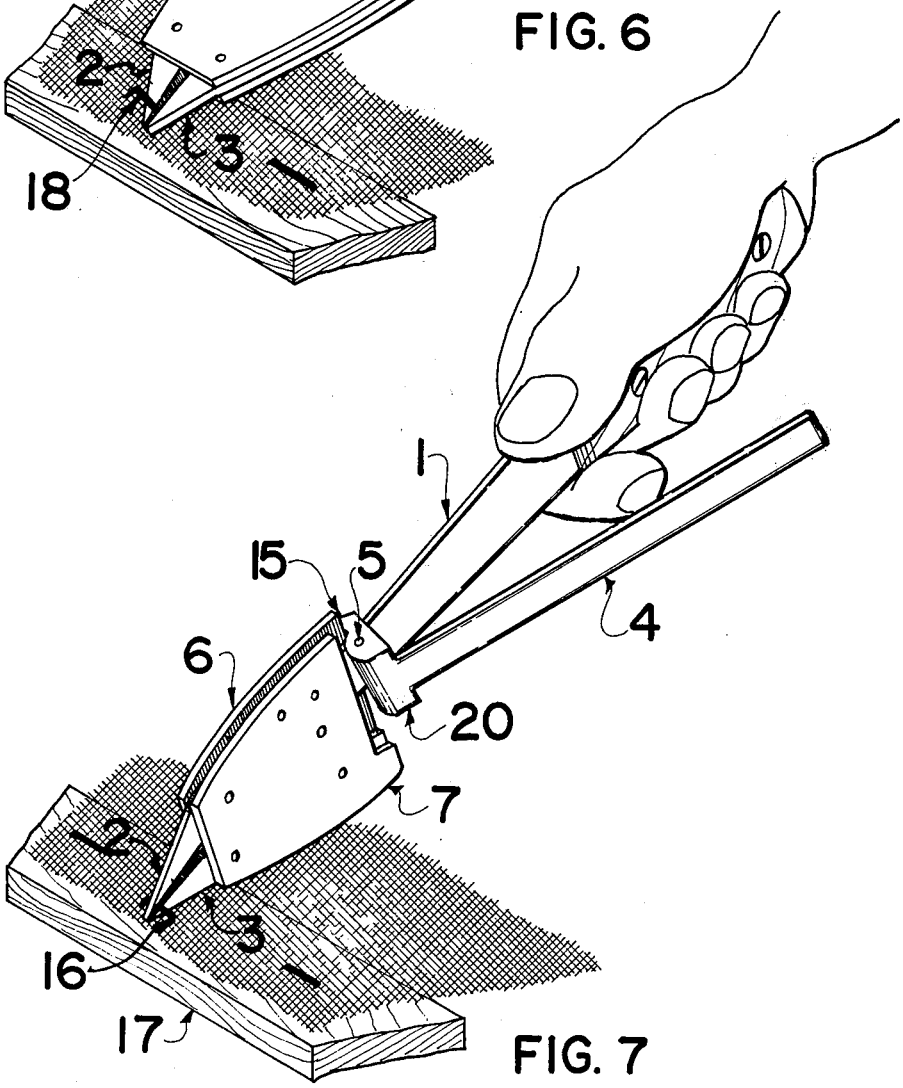
FIG. 7 is a perspective view of the staple remover of FIGS. 1–6 as it is being used to remove an intact staple.

In operation, the worker holding the staple remover by the primary handle 1 pushes the lower jaw 3 into the staple 16 between the bridge of the staple and the wood to which the staple is fastened as shown in FIG. 3. He then pushes the primary handle down towards the wood 17 to pry the staple 16 out of the wood 17 as seen in FIGS. 4 and 7. In so doing, since the primary handle 1 is pivotably secured to the lower jaw 3, the nose 10 of the primary handle 1 is pressed up against the trailing end 11 of the upper jaw 2 which in turn rotates the upper jaw 2 in a counterclockwise direction as seen in FIGS. 3 and 4 to close tightly against the upper face of the bridge of staple 16. In the preferred embodiment of the invention with the dimensions shown in FIG. 4 it can be shown that the leverage of the force applied to the primary handle 1 to the trailing end 11 of the upper jaw 2 multiplied by the leverage of the upper jaw 2 across pivot 12 provides a clamping force of $6/.5 \times .38/.7 \times F_h$, or $F_c = 6.5F_h$ where $F_c$ is the clamping force and $F_h$ is the force exerted on the handle. Since $F_h$ is directly proportional to the holding force of the staple in the wood, the clamping force increases with the force required to remove the staple. Thus in the staple remover of my invention, the staple remover holds the staple 16 tightly by its bridge as the prying force is applied to draw the legs of the staple loose from the wood. Thus the usual sliding action of the conventional remover which results in pulling one leg out at a time and breaking the staple is greatly lessened. This principle of my invention is similar to that used in the rail spike remover of Loreman, U.S. Pat. No. 813,223 however, the Loreman spike remover if turned on its side could in no way be used to grasp the remaining portion of a broken staple as in my remover. The improvement in the art as represented in my tool lies in the use of the needle nosed jaws which are spring-biased open to facilitate inserting the lowerjaw alone under the bridge of the staple 16 and the secondary handle 4 which allows the use of the same tool when held flat against the wood as a spring-biased-open needle nosed plier with a pair of handles which when hand squeezed will firmly grasp the remaining portion of a broken staple so as to pry it out of the wood as the handle end of the tool is raised with the nose of the tool serving as a fulcrum. Such use of the tool is shown in FIGS. 5 and 7. It will be noted in referring to FIG. 2 that as the secondary handle 4 is pressed towards the primary handle 1, an extension arm 15 on the secondary handle 4 presses against the right hand side plate 6 thus rotating the lower jaw 3 in a counterclockwise direction as seen in FIG. 5. The lower jaw 3 thus carries the pivot 12 of the upper jaw in a counter clockwise direction in relation to the primary handle 1 as seen in FIG. 5 pressing the trailing end 11 of the upper jaw 2 against the end 10 of the primary handle 1 so as to close the upper jaw 2 against the broken staple 18 clamping it tightly. With the operator's hand squeezing the primary handle 1 and secondary handle 4 together as seen in FIG. 6, the operator then uses the tips of the needle nose jaws 2 and 3 as a fulcrum to pry the staple portion 18 out of the wood in the manner of a needle nose plier. Although with the use of my staple remover removal of individual legs of staples should be much less frequent, it is possible that difficulty in removing a staple in one motion will be encountered because of the grain of the wood, damage to the staple by hammering, or because of uneven driving of the staple in installation.

Because of the simple and compact construction of this staple remover and the fact that the working parts can be in one plane, the needle-nose head of the remover is, in the working model, only 0.35 inch thick by 2.5 inches long by 1.375 inches wide at the widest point.

It is to be noted that when using my staple remover to remove a staple and one leg only is pried loose from the wood, the tool may be quickly flipped over in the hand just 90° and quickly used in the manner of a needle-nose plier to remove the other leg of the staple. Because the needle-nose staple remover plier of this invention is biased open, it can be easily operated by one hand for either operation.

Figure 8:
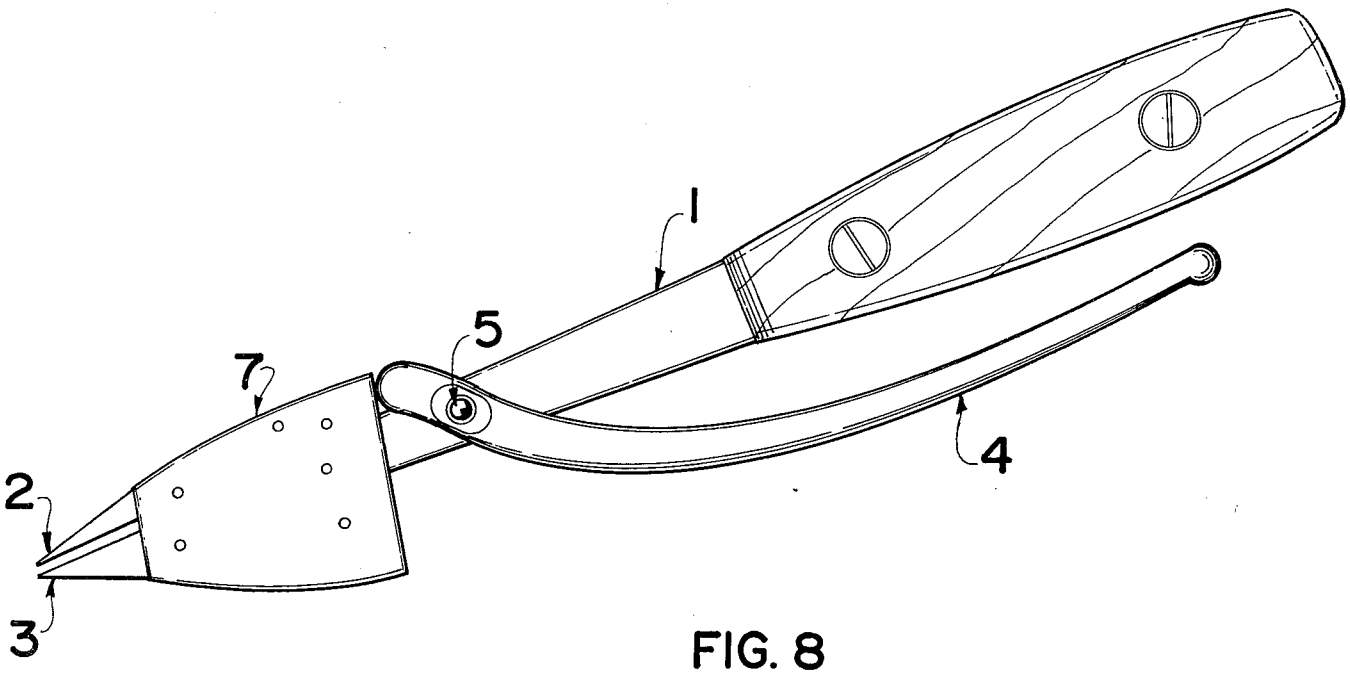
FIG. 8 is a side elevation of an alternative design of staple remover according to my invention and particularly the form of the secondary handle and its attachment to the primary handle differing from the form shown in FIGS. 1–7.

In the alternate design of my invention shown in FIG. 8, the secondary handle 4 is pivotably secured to the primary handle 1 by pivot pin 5 intersecting the longitudinal axes of the two handles. As will be noted by inspection of FIGS. 2–7, the pivot pin 5 secures the secondary handle 4 to the primary handle 1 through ears 19 on the side of the primary handle 1 and ears 20 on the side of the secondary handle 4.

I claim:

1. A tool for removing staples from wood and the like by clamping the staple to the tool as the staple is pried loose from the wood comprising:

a. a first substantially rectilinear lever;

b. a first tapered needle nose jaw;

c. a first pivot operably connecting said first jaw to said first lever;

d. a second tapered needle nose jaw;

e. a second pivot operably connecting said second jaw to said first jaw in such a position that the end of said first lever adjacent to said first pivot can engage the end of said second jaw distant from the tapered needle nose whereby relative movement of the first lever and the first jaw will open or close the space between said first and second jaws;

f. a spring bias operably attached to the first and second jaws so as to normally open the space between the first and second jaws; whereby when the first jaw is forced between the bridge of a staple and the material to which the staple is anchored, and the second end of the first lever is forced in such a direction as to pry the staple out of said anchoring material, the relative movement between the first lever and first jaw will close the space between the first and second jaws thus clamping the jaws against the staple bridge as the staple is pried loose;

g. a second rectiliniear lever; and h. a third pivot operably connecting the second lever to the first lever at a point on the first lever near the end of the first jaw which is distant from the tapered needle nose and near the end of said second lever to which the second lever is pivotably connected whereby said first and second levers lie alongside one another and as they are squeezed together, the second lever abuts the first jaw to close the space between said jaws in a clamping action.

* * * * *